US011944185B2

(12) United States Patent
Slattery

(10) Patent No.: US 11,944,185 B2
(45) Date of Patent: Apr. 2, 2024

(54) MODULAR ACCESSORY SYSTEM FOR STORAGE CONTAINERS WITH MOLLE WEBBING

(71) Applicant: Darren J. Slattery, Boulder, CO (US)

(72) Inventor: Darren J. Slattery, Boulder, CO (US)

( * ) Notice: Subject to any disclaimer, the term of this patent is extended or adjusted under 35 U.S.C. 154(b) by 23 days.

(21) Appl. No.: 17/329,979

(22) Filed: May 25, 2021

(65) Prior Publication Data

US 2021/0274920 A1 Sep. 9, 2021

Related U.S. Application Data

(63) Continuation-in-part of application No. 16/146,082, filed on Sep. 28, 2018, now Pat. No. 11,104,484.

(60) Provisional application No. 62/564,440, filed on Sep. 28, 2017.

(51) Int. Cl.

| | |
|---|---|
| ***A45F 3/04*** | (2006.01) |
| ***A45C 11/20*** | (2006.01) |
| ***A45C 13/00*** | (2006.01) |
| ***A45F 5/02*** | (2006.01) |
| ***F25D 3/08*** | (2006.01) |
| *A45C 13/30* | (2006.01) |

(52) U.S. Cl.

CPC ..... *A45F 5/02* (2013.01); *A45C 11/20* (2013.01); *A45C 13/001* (2013.01); *F25D 3/08* (2013.01); *A45C 2013/306* (2013.01); *A45F 3/04* (2013.01)

(58) Field of Classification Search

CPC ..... B65D 25/20; B65D 43/16; B65D 81/38; B65D 81/3813; B60N 3/102; B60N 3/104; A45F 5/02; A45C 11/20; A45C 13/001; A45C 2013/306; F25D 3/08

USPC ..... 248/213.2, 247, 248, 300, 310, 311.2, 248/312.1, 316.1, 316.7; 206/427, 429, 206/476, 486, 487, 558, 557, 560, 564, 206/567; 220/592.16, 592.18, 23.4, 737, 220/23.2; 211/71.01, 74, 75

See application file for complete search history.

(56) References Cited

U.S. PATENT DOCUMENTS

| | | | | |
|---|---|---|---|---|
| 47,288 | A * | 4/1865 | Fassmann | A44B 11/02 24/200 |
| 3,940,039 | A * | 2/1976 | Sasaki | A45F 5/02 224/264 |
| 5,990,402 | A * | 11/1999 | Epstein | G10D 13/063 84/453 |
| 7,389,608 | B1 * | 6/2008 | MacKay | A01K 97/20 206/315.11 |
| 8,079,503 | B1 * | 12/2011 | Yeates | A45C 7/0086 224/268 |
| 8,297,562 | B1 * | 10/2012 | Yeates | F41C 33/045 248/222.51 |
| 8,458,867 | B2 * | 6/2013 | Rogers | A45F 5/02 24/3.12 |
| 8,539,646 | B2 * | 9/2013 | Falvai | A44B 11/258 24/200 |

(Continued)

*Primary Examiner* — Steven M Marsh
(74) *Attorney, Agent, or Firm* — Will Hunziker

(57) ABSTRACT

A modular system for a container with MOLLE webbing is described, comprising a two component coupling system including: 1), a clip component which couples to the MOLLE on the container; and 2), a bracket component that couples to the clip and support various modular subcomponents. The same modular accessory system works with hard coolers while allowing the lid to close flat against the lip of the bucket while the modular accessories are in use.

18 Claims, 5 Drawing Sheets

(56) References Cited

U.S. PATENT DOCUMENTS

| | | | | |
|---|---|---|---|---|
| 8,764,360 | B2 * | 7/2014 | Vick | A44B 11/04 410/97 |
| 9,199,657 | B2 * | 12/2015 | Martin | A45C 5/143 |
| 9,265,318 | B1 * | 2/2016 | Williams | A45C 11/20 |
| 9,380,838 | B2 * | 7/2016 | Iannello | A45F 5/02 |
| 9,821,945 | B2 * | 11/2017 | Kuhn | A45F 3/14 |
| 9,913,464 | B1 * | 3/2018 | Stokes | F16M 13/02 |
| 10,029,842 | B2 * | 7/2018 | Seiders | A45C 11/20 |
| 10,054,354 | B1 * | 8/2018 | Kennedy | B62B 1/24 |
| 10,098,335 | B2 * | 10/2018 | Cooper | A01K 97/04 |
| 10,123,592 | B2 * | 11/2018 | Raymond | F41C 23/02 |
| 10,544,976 | B2 * | 1/2020 | Triska | A45C 11/20 |
| 10,548,373 | B2 * | 2/2020 | Sorensen | A44B 11/065 |
| 10,788,299 | B2 * | 9/2020 | Schandelmeier | F42B 39/02 |
| 11,129,448 | B1 * | 9/2021 | Cretikos | A44B 11/12 |
| 11,172,752 | B2 * | 11/2021 | Dow | A47G 23/02 |
| 2007/0089277 | A1 * | 4/2007 | Bacalso | A44B 11/2503 24/200 |
| 2008/0236712 | A1 * | 10/2008 | Chisolm | A45C 15/00 150/132 |
| 2013/0193179 | A1 * | 8/2013 | Davidson | B60R 7/043 224/584 |
| 2018/0008024 | A1 * | 1/2018 | Barton | A45F 3/04 |
| 2018/0073801 | A1 * | 3/2018 | Murphy | F25D 25/02 |
| 2019/0127109 | A1 * | 5/2019 | Johnson | B65D 7/06 |
| 2019/0161240 | A1 * | 5/2019 | Ahlström | B65D 25/2841 |
| 2019/0166981 | A1 * | 6/2019 | Revels | A45F 3/10 |

* cited by examiner

MODULAR ACCESSORY SYSTEM FOR STORAGE CONTAINERS WITH MOLLE WEBBING

CROSS-REFERENCE TO RELATED APPLICATIONS

This application claims the benefit of U.S. non-provisional patent application Ser. No. 62/564,440; filed Sep. 28, 2018; titled "Utility Bracket for Portable Storage Containers" as a continuation in part; which claims the benefit of U.S. provisional patent application Ser. No. 62/564,440; filed Sep. 28, 2017; titled "Utility Bracket for Portable Storage Containers"; both of which are hereby incorporated in their entirety for all purposes herein.

BACKGROUND OF THE INVENTION

1. Field of the Invention

The present invention is in the technical field of storage container attachments. More particularly, the present invention pertains to the field of cooler attachments to the MOLLE webbing of a soft cooler.

2. Description of Related Art

Many high end brands of portable coolers have created soft coolers that are typically smaller, handheld, easy stored when empty, and are generally a better option when storage and the ability to keep beverages cold is not the primary consideration and the user simply needs and insulated bag to keep drinks for a few people cold for short while.

There are many versions of soft coolers, and many (perhaps most) of them are made very cheaply and are practically disposable; however, among the higher end brands, such as: Yeti, Pelican, Titan, Coleman, Tourit, Sovaro, and Dakine, to name just a few; almost all incorporate Modular Lightweight Load-carrying Equipment webbing, called "MOLLE" webbing, which is standard on the side of military backpacks and is made of columns of heavy-duty nylon straps stitched onto the cooler to allow for the attachment of various compatible pouches and accessories.

The present invention takes advantage of Modular Lightweight Load-carrying Equipment webbing and the inherent weight of a full cooler to provide useful attachments for the soft cooler, which can also be conveniently stored in the cooler when not in use; which, among other things, allows the user to hold drinks, cutting boards, fishing rods, and anything else the user desires to keep out of the dirt.

Because of the standardized nature of Modular Lightweight Load-carrying Equipment webbing, the present invention can also be used on other containers with columns of MOLLE straps, such as backpacks.

SUMMARY

The scope of the present invention is defined solely by the appended claims and detailed description of a preferred embodiment and is not affected to any degree by the statements within this summary. A modular system for a soft cooler, backpack, or other container with columns of Modular Lightweight Load-carrying Equipment Webbing is described, comprising a two component coupling system including: 1), a clip component which couples to the MOLLE on the container; and 2), a bracket component that couples to the clip and support various modular subcomponents. The bracket permits additional storage, receptacles, or fasteners to be mounted on the container; such as a cutting board, cup holders, fishing rod holder etc. without interfering with the operation of the container. A removable fastener permits the various subcomponents to be attached to the bracket.

In another embodiment, the same modular accessory system for storage containers that work on soft coolers also works with hard coolers while also permitting the lid of such hard cooler to close flat against the lip of the bucket portion with the bracket extending between the lid and the bucket.

BRIEF DESCRIPTION OF THE DRAWINGS

Various embodiments are described herein with reference to the following Drawings Certain aspects of the Drawings are depicted in a simplified way for reason of clarity. Not all alternatives and options are shown in the Drawings and, therefore, the Claims are not limited in scope to the content of the Drawings.

1. FIGURES

Figure 1:
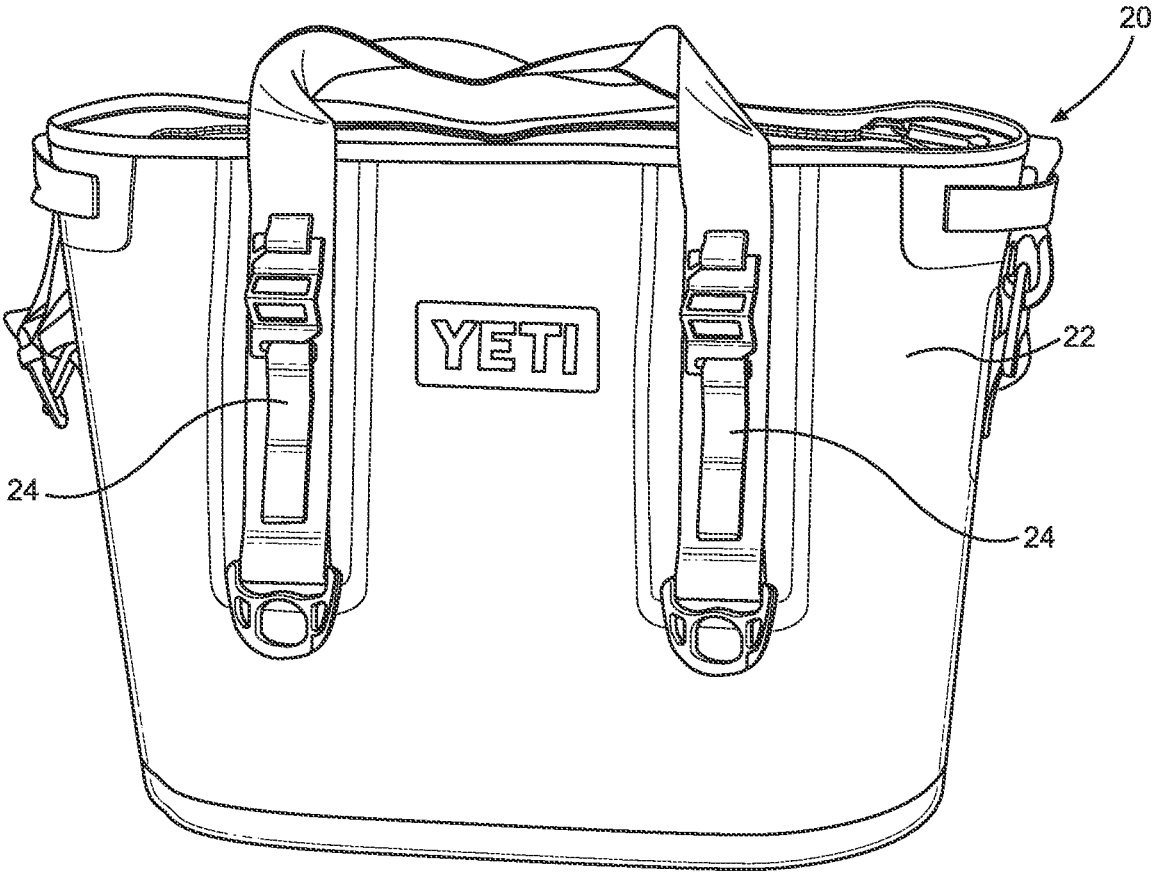

FIG. 1 illustrates a storage container with MOLLE straps.

Figure 2:
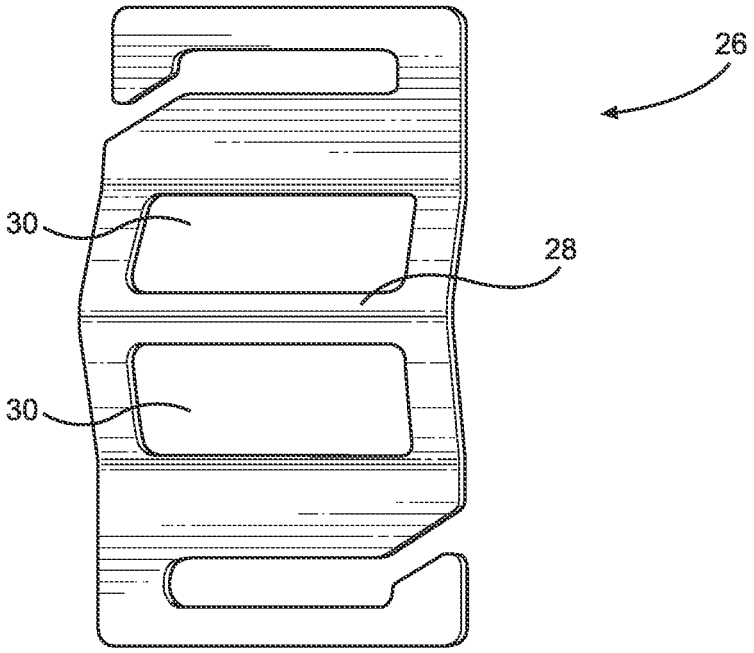

FIG. 2 illustrates a Molle strap clip, in accordance with an embodiment of the present disclosure.

Figure 3:
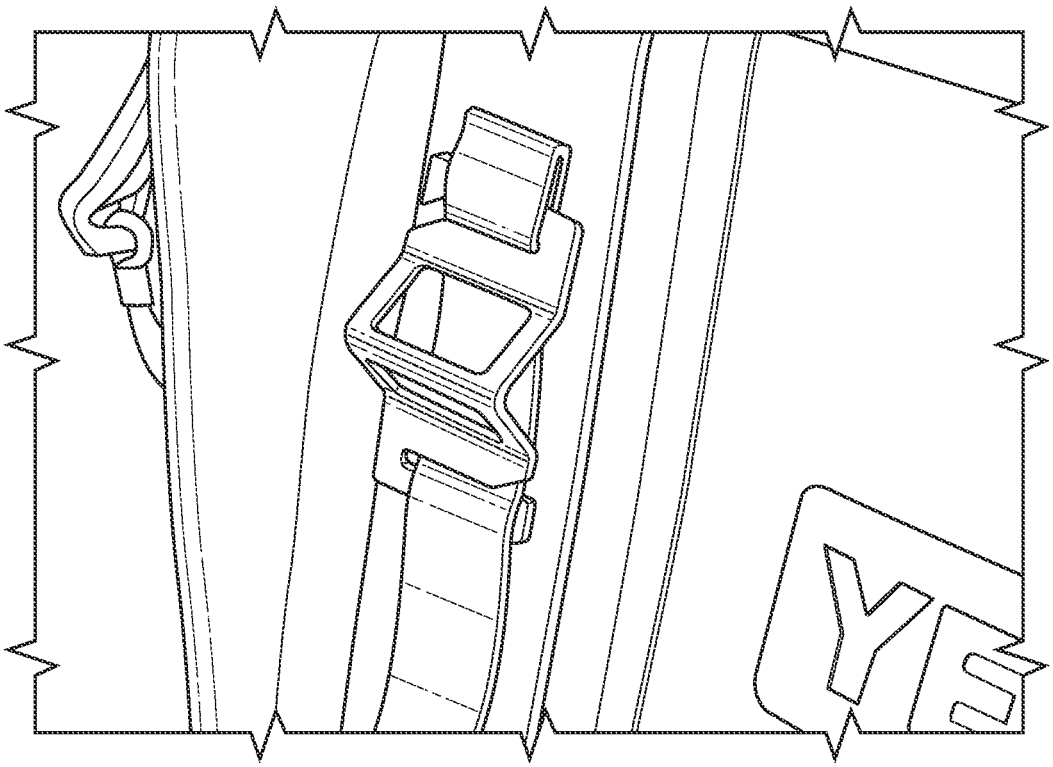

FIG. 3 illustrates a soft cooler with MOLLE strap clip, in accordance with an embodiment of the present disclosure.

Figure 4:
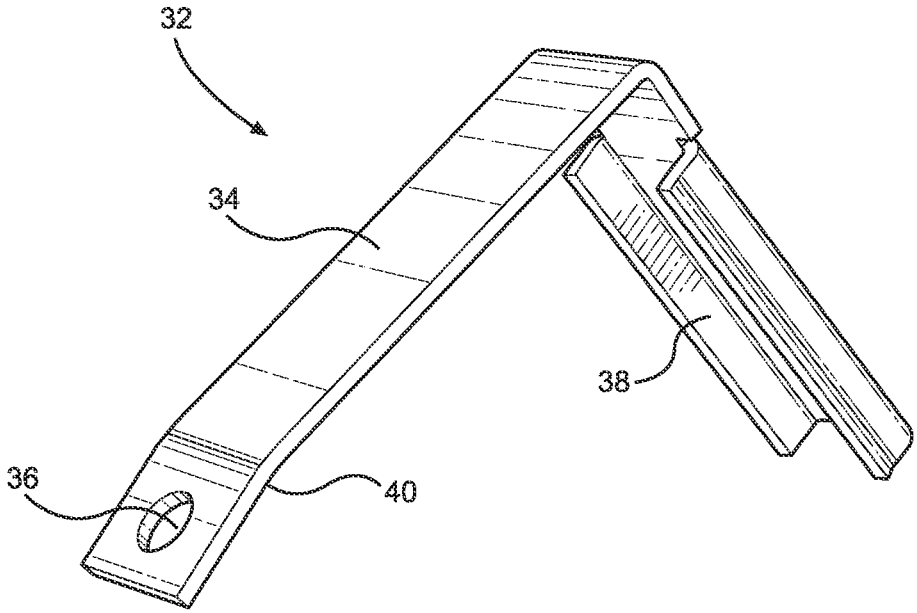

FIG. 4 illustrates a bracket, in accordance with an embodiment of the present disclosure.

Figure 5:
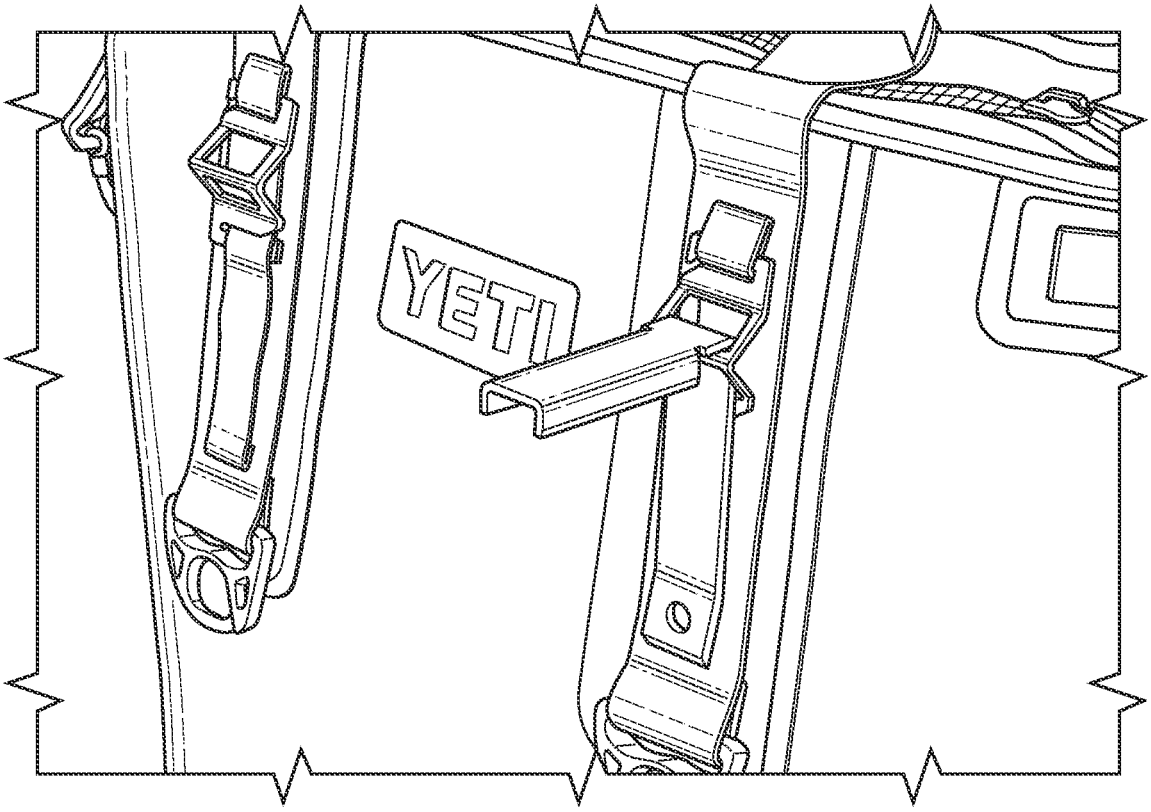

FIG. 5 illustrates a soft cooler with MOLLE strap clip and a bracket, in accordance with an embodiment of the present disclosure.

Figure 6:
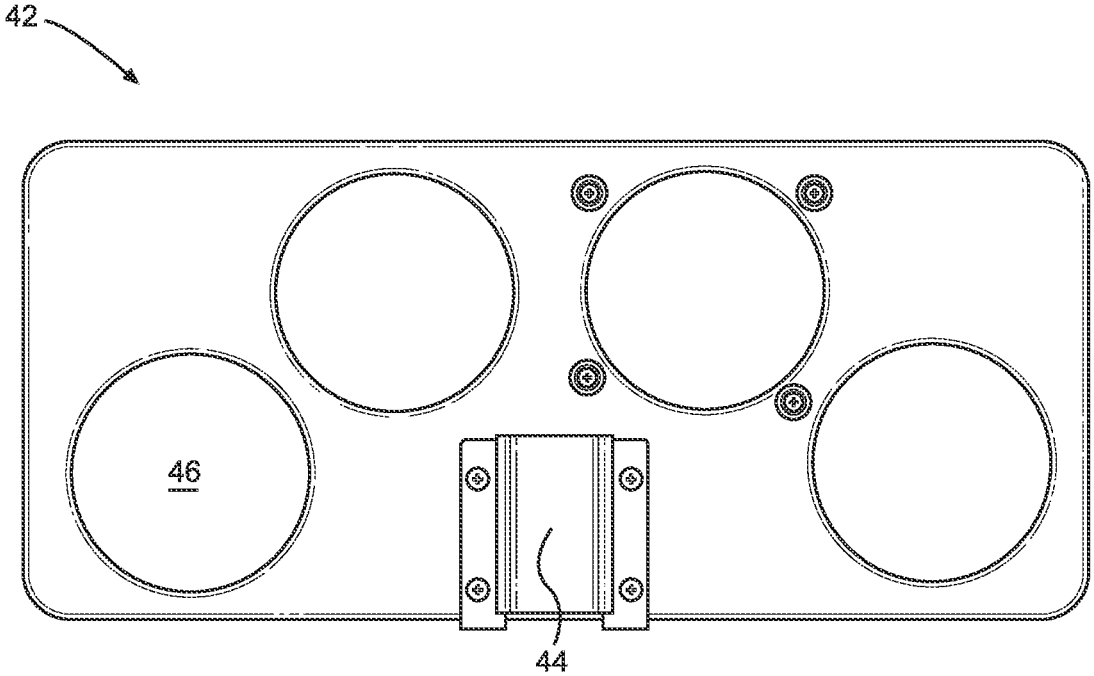

FIG. 6 illustrates a modular accessory, in accordance with an embodiment of the present disclosure.

Figure 7:
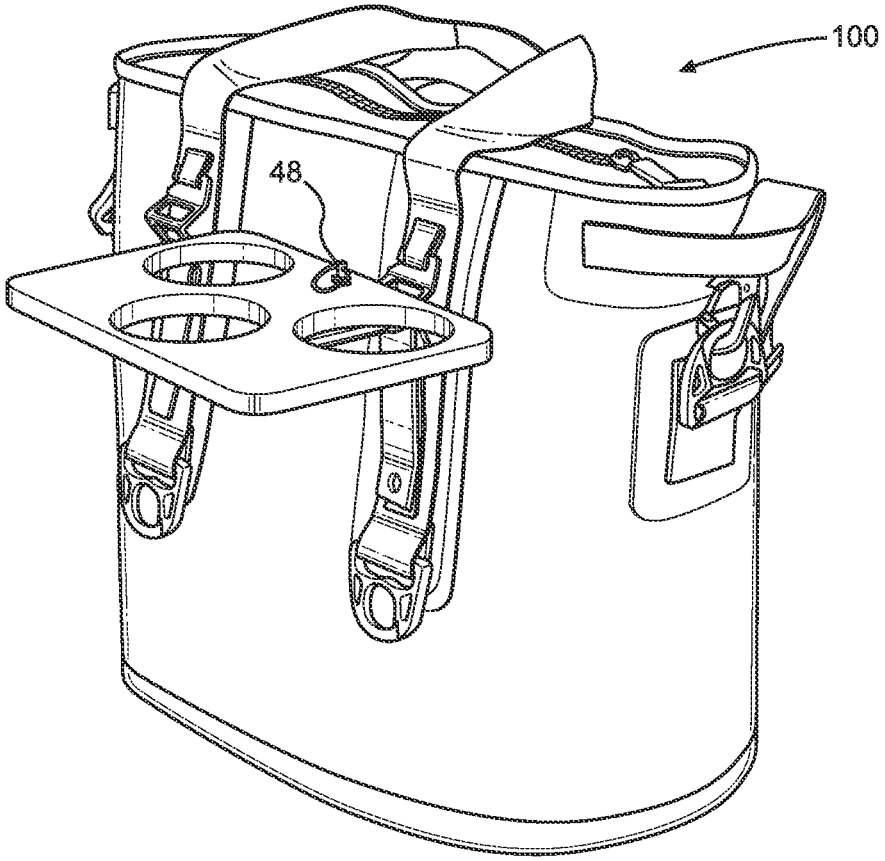

FIG. 7 illustrates a soft cooler with a modular accessory system, in accordance with an embodiment of the present disclosure.

Figure 8:
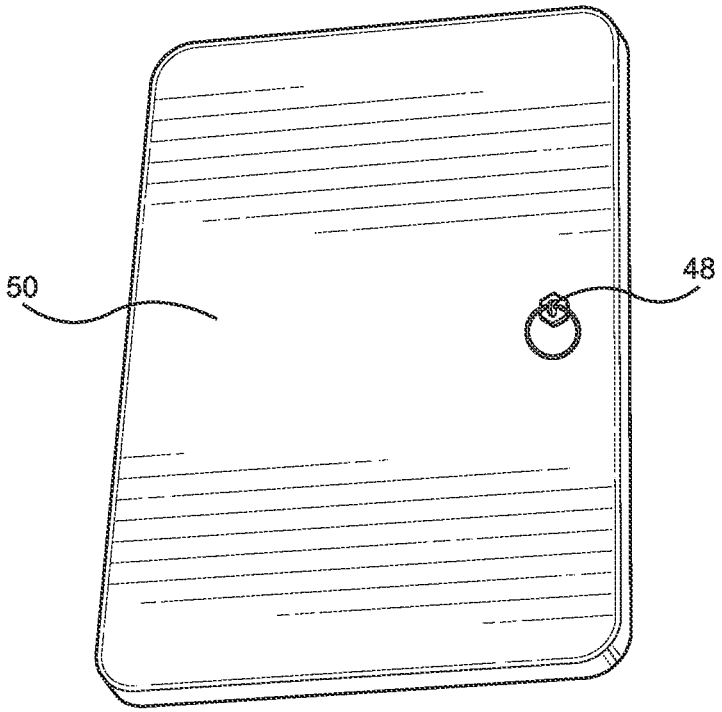

FIG. 8 illustrates a soft cooler with a modular accessory system with a cutting board, in accordance with an embodiment of the present disclosure.

Figure 9:
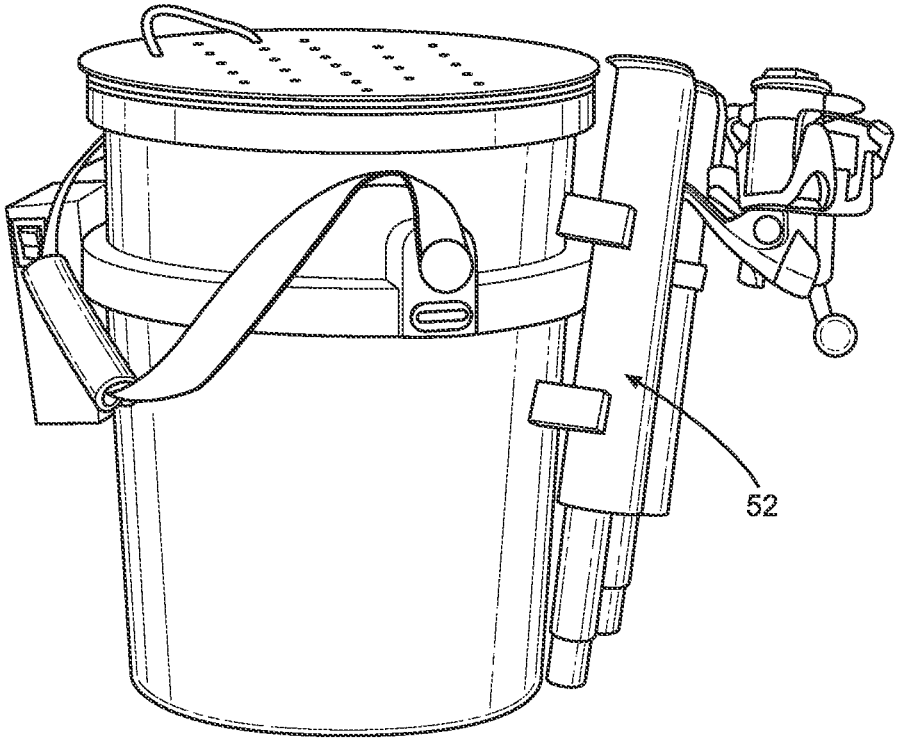

FIG. 9 illustrates a soft cooler with a modular accessory system with a fishing rod holder, in accordance with an embodiment of the present disclosure.

Figure 10:
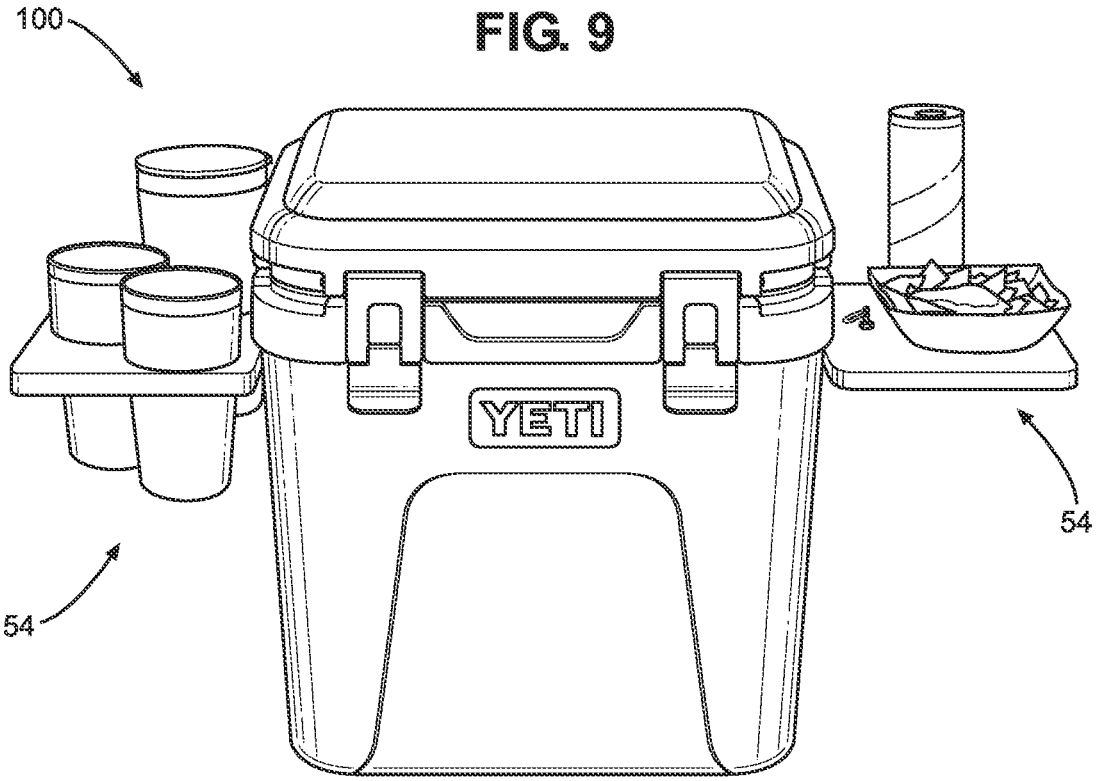

FIG. 10 illustrates a Modular Accessory System for Hard-sided Coolers with Tie Down Strap Slots and a Flush Lid, in accordance with an embodiment of the present disclosure.

2. REFERENCES

20 Container
22 Soft Cooler
24 Columns of Modular Lightweight Load-carrying Equipment Straps
26 MOLLE Strap Clip
28 MOLLE Strap Clip Coupling Component
30 MOLLE Strap Clip Coupling Component Slot Subcomponents
32 Bracket
34 Bracket MOLLE Strap Clip Coupling Component
36 Bracket MOLLE Strap Clip Retaining Component
38 Bracket Modular Accessory Coupling Component
40 Bracket Angled Tip
42 Modular Accessory
44 Modular Accessory Bracket Coupling Component

46 Modular Accessory Cup Holder Component
48 Modular Accessory Bracket Retaining Component
50 Modular Accessory Cutting Board Component
52 Modular Accessory Fishing Rod Holder Component
54 Modular Accessory System for Hard-sided Coolers with Tie Down Strap Slots
100 Modular Accessory System for Storage Containers with MOLLE Webbing

DETAILED DESCRIPTION

The following description is not to be taken in a limiting sense but is made merely for the purpose of describing the general principles of exemplary embodiments, many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Unless otherwise indicated, the drawings are intended to be read (e.g., arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

For the purposes of promoting and understanding of the principles of the present invention, reference will now be made to the embodiments illustrated in the drawings and specific language will be used to describe the same.

FIG. 1 illustrates a container (20), which in this embodiment is a soft cooler (22), the soft cooler has at least one strap which is attached to the soft cooler with Modular Lightweight Load-carrying Equipment webbing, also called "MOLLE" webbing (24). In this patent, MOLLE webbing may comprise either a row of lops with holes going up and down or a column of loops with holes going side to side made from one or more straps and are not limited to traditional horizontal rows of loops common on military equipment for use with MOLLE sticks.

FIG. 2 illustrates MOLLE strap clip (26). In this embodiment said MOLLE strap clip (26) is metallic and reversible in an up and down orientation but not in a front and back orientation as it extends forward from its front. The MOLLE strap clip clips to the MOLLE strap and has one or more MOLLE strap clip coupling component(s) (28); which, in this embodiment, further comprises two MOLLE Strap Clip Coupling Component Slot Subcomponents (30) for coupling with a bracket (32). Said optional MOLLE Strap Clip Coupling Component Slot Subcomponents (30) may also function as bottle openers.

FIG. 3 illustrates an embodiment of a soft cooler with an attached MOLLE strap clip.

FIG. 4 illustrates one embodiment of a bracket (32), in this embodiment it is an L shaped bracket made from a single piece of metal. The bracket may comprise a bracket MOLLE strap clip coupling component (34) that couples with the MOLLE strap clip (26), in this embodiment the bracket MOLLE strap clip coupling component is the downward pointing side of the L bracket that is dropped through the slots in the MOLLE strap clip. The bracket MOLLE strap clip coupling component may also have a bracket MOLLE strap clip retaining component (36). In this embodiment the retaining component (36) is a hole through which something can pass which will prevent the bracket from being removed from the MOLLE strap clip. The bracket may also have an angled tip (40), which will allow it to insert through the MOLLE Strap Clip Coupling Component Slot Subcomponents (30) easily.

FIG. 5 illustrates one embodiment of a bracket coupled with a MOLLE strap clip.

FIG. 6 illustrates one embodiment of a modular accessory (42). The modular accessory may have a modular accessory bracket coupling component (44) that allows the modular accessory to couple to the bracket. In this embodiment, the modular accessory shown is a cup holder (46).

FIG. 7 illustrates one embodiment of a modular accessory system for storage containers with MOLLE webbing (100). The modular accessory system for storage containers with MOLLE webbing (100) comprises: a MOLLE strap clip (26), a bracket (32), and a modular accessory (42). In this embodiment, the modular accessory has an optional modular accessory bracket retaining component (48) which retains the coupling between the bracket modular accessory coupling component (38) and the modular accessory bracket coupling component (44). In this embodiment the modular accessory bracket retaining component (48) is a pressure fit pin, but it could be a bolt, snap, button, tie, zipper, or whatever else is useful to retain couplings.

FIG. 8 illustrates a modular accessory (42) comprising a modular accessory cutting board component (50).

FIG. 9 illustrates a modular accessory (42) comprising a modular accessory fishing rod holder component (52).

FIG. 10 illustrates a modular accessory system for hard-sided coolers with tie down strap slots (54). The modular accessory system for storage containers with MOLLE webbing (100) may be also be used on a hard-sided coolers with tie down strap slots by sliding the bracket through the tie down strap slot and coupling the modular attachment to the bracket.

Information as herein shown and described in detail is fully capable of attaining the above-described object of the present disclosure, the presently preferred embodiment of the present disclosure; and is, thus, representative of the subject matter; which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

What is claimed is:

1. An accessory to a container with a lid and a bucket portion, the bucket portion including a lip on at least one side of a top part of the bucket portion and a through opening in the lip extending downward and another connected recessed outward opening from the lip and a lid that that goes over the through opening on the lip and is flat above the connected recessed outward opening from the lip, the accessory comprising:

an integral L shaped bracket with two extensions at a right angle to each other;

a first one of the extensions being configured to cooperate with the through opening in the lip of the bucket portion for support; and a second one of the extensions being configured to extend away from the bucket portion when the first one of the extensions cooperates with the through opening, wherein said second extension accommodates said connected recessed outward opening and is configured to provide support and stability for the bracket and to permit the lid to close flat against the lip of the bucket portion with the bracket extending between the lid and the bucket;

wherein said first extension is also configured to cooperate with a modular lightweight load-carrying equipment (MOLLE) strap clip coupling component on a MOLLE strap clip with a MOLLE strap clip coupling component.

2. The accessory of claim 1, wherein said bracket MOLLE strap clip coupling component comprises two slots.

3. The accessory of claim 2, wherein said slots are also bottle openers.

4. The accessory of claim 1, wherein said bracket has a strap clip retaining component.

5. The accessory of claim 1, wherein said first one of the extensions is tapered to allow quick installation through the opening in the lip of the bucket portion.

6. The accessory of claim 1, further comprising a retaining device on the first one of the extensions for retaining the bracket in the through opening in the lip of the bucket portion.

7. The accessory of claim 1, wherein said container is a cooler.

8. The accessory of claim 1, wherein said storage container is a soft cooler.

9. The accessory of claim 1, wherein said storage container is a backpack.

10. The accessory of claim 1, further comprising a shelf.

11. The accessory of claim 1, further comprising a cup holder.

12. The accessory of claim 1, further comprising a cutting board.

13. The accessory of claim 1, further comprising a fishing rod holder.

14. The accessory of claim 1, further comprising an attachment structure on the second one of the extensions configured to support a plurality of attachments.

15. The accessory of claim 14, wherein one of said plurality of attachments is a shelf.

16. The accessory of claim 14, wherein one of said plurality of attachments is a cup holder.

17. The accessory of claim 14, wherein one of said plurality of attachments is a cutting board.

18. The accessory of claim 14, wherein one of said plurality of attachments is a fishing rod holder.

* * * * *